US010636299B2

(12) United States Patent
Malkes et al.

(10) Patent No.: US 10,636,299 B2
(45) Date of Patent: Apr. 28, 2020

(54) SYSTEM AND METHOD FOR CONTROLLING VEHICULAR TRAFFIC

(71) Applicant: Cubic Corporation, San Diego, CA (US)

(72) Inventors: William A. Malkes, Knoxville, TN (US); William S. Overstreet, Knoxville, TN (US); Jeffery R. Price, Knoxville, TN (US); Michael J. Tourville, Lenoir City, TN (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/044,891

(22) Filed: Jul. 25, 2018

(65) Prior Publication Data

US 2019/0051152 A1 Feb. 14, 2019

Related U.S. Application Data

(60) Provisional application No. 62/544,504, filed on Aug. 11, 2017.

(51) Int. Cl.
*G08G 1/07* (2006.01)
*G08G 1/015* (2006.01)
(Continued)

(52) U.S. Cl.
CPC ..... *G08G 1/015* (2013.01); *G08G 1/04* (2013.01); *G08G 1/08* (2013.01); *G08G 1/081* (2013.01);
(Continued)

(58) Field of Classification Search
CPC ..... G08G 1/015; G08G 1/04; G08G 1/08; G08G 1/081
See application file for complete search history.

(56) References Cited

U.S. PATENT DOCUMENTS 4,833,469 A 5/1989 David
5,111,401 A 5/1992 Everett et al.
(Continued)

FOREIGN PATENT DOCUMENTS

CN 100533151 8/2009
CN 101799987 8/2010
(Continued)

OTHER PUBLICATIONS

U.S. Appl. No. 16/030,396 Office Action dated Nov. 20, 2018.
(Continued)

*Primary Examiner* — Phung Nguyen
(74) *Attorney, Agent, or Firm* — Kilpatrick Townsend & Stockton, LLP

(57) ABSTRACT

The present disclosure is directed to systems, methods and computer-readable mediums for controlling traffic using traffic rules generated based on types of vehicles and associated traffic flow rates. In one aspect, a device includes memory having computer-readable instructions stored therein and one or more processors. The one or more processors are configured to execute the computer-readable instructions to receive video data of traffic flowing through an intersection; based on the video data, determine if a rate of flow of the traffic is greater than a predetermined threshold; determine a correlation between the rate of flow and one of a plurality of object types if the rate of flow is not greater than the predetermined threshold; determine a rule for controlling the traffic flow through the intersection based on the correlation; and cause adjustments to traffic control settings of a traffic light at the intersection based on the rule.

20 Claims, 8 Drawing Sheets

(51) Int. Cl.

| | |
|---|---|
| ***G08G 1/08*** | (2006.01) |
| ***G08G 1/081*** | (2006.01) |
| ***G08G 1/04*** | (2006.01) |
| *G08G 1/01* | (2006.01) |

(52) U.S. Cl.

CPC ..... *G08G 1/0116* (2013.01); *G08G 1/0145* (2013.01)

(56) References Cited

U.S. PATENT DOCUMENTS

| | | | | |
|---|---|---|---|---|
| 5,208,584 | A | 5/1993 | Kaye et al. | |
| 5,406,490 | A | 4/1995 | Braegas | |
| 5,444,442 | A | 8/1995 | Sadakata et al. | |
| 6,064,139 | A | 5/2000 | Ozawa et al. | |
| 6,075,874 | A | 6/2000 | Higashikubo et al. | |
| 6,317,058 | B1 | 11/2001 | Lemelson et al. | |
| 6,366,219 | B1 | 4/2002 | Hoummady | |
| 6,405,132 | B1 | 6/2002 | Breed et al. | |
| 6,505,046 | B1 | 1/2003 | Baker | |
| 6,526,352 | B1 | 2/2003 | Breed et al. | |
| 6,720,920 | B2 | 4/2004 | Breed et al. | |
| 6,741,926 | B1 | 5/2004 | Zhao et al. | |
| 6,751,552 | B1 | 6/2004 | Minelli | |
| 6,768,944 | B2 | 7/2004 | Breed et al. | |
| 6,862,524 | B1 | 3/2005 | Nagda et al. | |
| 6,937,161 | B2 | 8/2005 | Nishimura | |
| 7,110,880 | B2 | 9/2006 | Breed et al. | |
| 7,610,146 | B2 | 10/2009 | Breed | |
| 7,630,806 | B2 | 12/2009 | Breed | |
| 7,698,055 | B2 | 4/2010 | Horvitz et al. | |
| 7,698,062 | B1 | 4/2010 | McMullen et al. | |
| 7,821,421 | B2 | 10/2010 | Tamir et al. | |
| 7,835,859 | B2 | 11/2010 | Bill | |
| 7,899,611 | B2 | 3/2011 | Downs et al. | |
| 7,979,172 | B2 | 7/2011 | Breed | |
| 8,050,863 | B2 | 11/2011 | Trepagnier et al. | |
| 8,135,505 | B2 | 3/2012 | Vengroff et al. | |
| 8,144,947 | B2 | 3/2012 | Kletter | |
| 8,212,688 | B2 | 7/2012 | Morioka et al. | |
| 8,255,144 | B2 | 8/2012 | Breed et al. | |
| 8,373,582 | B2 | 2/2013 | Hoffberg | |
| 8,566,029 | B1 | 10/2013 | Lopatenko et al. | |
| 8,589,069 | B1 | 11/2013 | Lehman | |
| 8,682,812 | B1 | 3/2014 | Ran | |
| 8,706,394 | B2 | 4/2014 | Trepagnier et al. | |
| 8,825,350 | B1 | 9/2014 | Robinson | |
| 8,903,128 | B2 | 12/2014 | Shet et al. | |
| 9,043,143 | B2 | 5/2015 | Han | |
| 9,387,928 | B1 | 7/2016 | Gentry et al. | |
| 9,965,951 | B1 * | 5/2018 | Gallagher | G08G 1/0145 |
| 2003/0210156 | A1 * | 11/2003 | Nishimura | G08G 1/08 340/907 |
| 2004/0155811 | A1 | 8/2004 | Albero et al. | |
| 2005/0187708 | A1 | 8/2005 | Joe et al. | |
| 2007/0162372 | A1 | 7/2007 | Anas | |
| 2007/0208494 | A1 | 9/2007 | Chapman et al. | |
| 2007/0273552 | A1 | 11/2007 | Tischer | |
| 2008/0094250 | A1 | 4/2008 | Myr | |
| 2008/0195257 | A1 | 8/2008 | Rauch | |
| 2009/0048750 | A1 | 2/2009 | Breed | |
| 2009/0051568 | A1 | 2/2009 | Corry et al. | |
| 2011/0037618 | A1 | 2/2011 | Ginsberg et al. | |
| 2011/0043378 | A1 * | 2/2011 | Bailey | G08G 1/07 340/917 |
| 2011/0205086 | A1 | 8/2011 | Lamprecht et al. | |
| 2012/0038490 | A1 | 2/2012 | Verfuerth | |
| 2012/0112928 | A1 | 5/2012 | Nishimura et al. | |
| 2014/0136414 | A1 | 5/2014 | Abhyanker | |
| 2014/0277986 | A1 | 9/2014 | Mahler et al. | |
| 2017/0169309 | A1 | 6/2017 | Reddy et al. | |
| 2018/0075739 | A1 | 3/2018 | Ginsberg et al. | |
| 2018/0190111 | A1 * | 7/2018 | Green | G08G 1/0145 |
| 2019/0043349 | A1 * | 2/2019 | Hofman | G08G 1/08 |
| 2019/0049264 | A1 | 2/2019 | Malkes | |
| 2019/0050647 | A1 | 2/2019 | Malkes | |
| 2019/0051160 | A1 | 2/2019 | Malkes | |
| 2019/0051161 | A1 | 2/2019 | Malkes | |
| 2019/0051162 | A1 | 2/2019 | Malkes | |
| 2019/0051163 | A1 | 2/2019 | Malkes | |
| 2019/0051164 | A1 | 2/2019 | Malkes | |
| 2019/0051167 | A1 | 2/2019 | Malkes | |
| 2019/0051171 | A1 | 2/2019 | Malkes | |

FOREIGN PATENT DOCUMENTS

| | | |
|---|---|---|
| CN | 101944295 | 1/2011 |
| EP | 0 464 821 | 1/1992 |
| KR | 2013-0067847 | 6/2013 |

OTHER PUBLICATIONS

U.S. Appl. No. 16/058,343 Office Action dated Nov. 19, 2018.

Dehghan et al., Afshin; "Automatic Detection and Tracking of Pedestrians in Videos with Various Crowd Densities", Pedestrian and Evacuation Dynamics 2012.

Dubska et al.; "Automatic Camera Calibration for Traffic Understanding", bmva.org, 2014.

Grosser, Kari; "Smart lo T Technologies for Adaptive Traffic Management Using a Wireless Mes Sensor Network", Advantech Industrial lo T Blog, Feb. 3, 2017.

https://www.flir.com, 2018.

Halper, Mark; Smart Cameras Will Help Spokane Light It's World More Intelligently (Updated), LEDs Magazine, and Business/Energy/Technology Journalist, Apr. 19, 2017.

Heaton, Brian; "Smart Traffic Signals Get a Green Light", Government Technology Magazine, Feb. 15, 2012.

Kolodny, Lora; Luminar reveals sensors that could make self-driving cars safer than human, Techcrunch, Apr. 13, 2017.

McDermott, John; "Google's newest secret weaon for local ads", Digiday, Jan. 29, 2014.

Resnick, Jim; "How Smart Traffic Signals May Ease Your Commute", BBC, Autos, Mar. 18, 2015.

Sun et al., M.; "Relating Things and Stuff Via Object Property Interactions", cvgl.stanford.edu, Sep. 4, 2012.

Whitwam, Ryan; "How Google's self-driving cars detect and avoid obstacles", ExtremeTech, Sep. 8, 2014.

Yamaguchi, Jun'ichi; "Three Dimensional Measurement Using Fisheye Stereo Vision", Advances in Theory and Applications of Stereo Vision, Dr. Asim Bhatti (Ed.), ISBN:978-953-307-516-7, InTech. Jan. 8, 2011.

U.S. Appl. No. 16/030,396, William A. Malkes, System and Method Adaptive Controlling of Traffic Using Camera Data, filed Jul. 9, 2018.

U.S. Appl. No. 16/032,886, William A. Malkes, Adaptive Traffic Control Using Object Tracking and Identity Details, filed Jul. 11, 2018.

U.S. Appl. No. 16/058,106, William A. Malkes, System and Method for Managing Traffic by Providing Recommendations to Connected Objects, filed Aug. 8, 2018.

U.S. Appl. No. 16/059,814, William A. Malkes, System and Method of Navigation Vehicles, filed Aug. 9, 2018.

U.S. Appl. No. 16/059,886, William A. Malkes, Systems and Methods of Adaptive Traffic Optimization Using Unmanned Aerial Vehicles, filed Aug. 9, 2018.

U.S. Appl. No. 16/058,214, William A. Malkes, System and Method of Adaptive Traffic Management, filed Aug. 8, 2018.

U.S. Appl. No. 16/100,750, William A. Malkes, System and Method of Adaptive Traffic Management at an Intersection, filed Aug. 10, 2018.

U.S. Appl. No. 16/101,766, William A. Malkes, System and Method for Retail Revenue Based Traffic Management, filed Aug. 10, 2018.

U.S. Appl. No. 16/101,933, William A. Malkes, Adaptive Optimization of Navigational Routes Using Traffic Data, filed Aug. 13, 2018.

(56) References Cited

OTHER PUBLICATIONS

U.S. Appl. No. 16/058,343, William A. Malkes, System and Method of Adaptive Controlling of Traffic Using Zone Based Occupancy, filed Aug. 8, 2018.

* cited by examiner

802

| Light Phase | Green light Timing | Yellow light Timing | Red Light timing |
|---|---|---|---|
| A–C | 10 | 5 | 10 |
| B-D | 10 | 5 | 10 |

SYSTEM AND METHOD FOR CONTROLLING VEHICULAR TRAFFIC

CROSS-REFERENCE TO RELATED APPLICATIONS

This application claims priority to U.S. Provisional Patent Application No. 62/544,504 filed on Aug. 11, 2017, the entire content of which is incorporated herein by reference.

FIELD OF THE DISCLOSURE

The present disclosure is generally related to traffic control systems, and more particularly related to controlling traffic using traffic rules generated based on types of objects present in a traffic stream and associated traffic flow rates.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

Controlling vehicular traffic on roads is essential for transportation of persons and goods. Further, vehicular traffic may include various types of vehicles such as trucks, buses, cars, bikes, etc. in a traffic stream. Typically, vehicular traffic is controlled using traffic light switching systems. For example, a traffic light switching system is used to detect vehicles approaching or waiting at a road intersection and change the status of the traffic lights accordingly (i.e. from the red light being illuminated indicating stop to the green light being illuminated indicating go).

Generally, traffic light systems have pre-programmed timing which is updated every year or few years, based on traffic conditions and available resources. However, frequent changes in traffic patterns result in the outdating of traffic light switching systems and cause traffic inefficiencies. Such inefficiencies result in environmental pollution that can create or exacerbate health problems. Therefore, there is a need for updating the pre-programmed timing of traffic systems in real-time as traffic patterns change.

Thus, the current state of art does not provide real-time traffic optimization. Therefore, there is a need to improve traffic signaling for different types of vehicles, in real-time, for controlling vehicular traffic.

SUMMARY

One or more example embodiments of inventive concepts are directed to providing adaptive traffic control at an intersection (or a group of intersections in vicinity of each other) based on analysis of types of objects detected at the intersection and a correlation thereof to traffic flow rates.

One aspect of the present disclosure includes a device with memory having computer-readable instructions stored therein and one or more processors. The one or more processors are configured to execute the computer-readable instructions to receive video data of traffic flowing through an intersection; based on the video data, determine if a rate of flow of the traffic is greater than a predetermined threshold; determine a correlation between the rate of flow and one of a plurality of object types if the rate of flow is not greater than the predetermined threshold; determine a rule for controlling the traffic flow through the intersection based on the correlation; and cause adjustments to traffic control settings of a traffic light at the intersection based on the rule.

One aspect of the present disclosure includes one or more non-transitory computer-readable medium having computer-readable instructions stored therein, which when executed by one or more processors, cause the one or more processors to receive video data of traffic flowing through an intersection; based on the video data, determine if a rate of flow of the traffic is greater than a predetermined threshold; determine a correlation between the rate of flow and one of a plurality of object types if the rate of flow is not greater than the predetermined threshold; determine a rule for controlling the traffic flow through the intersection based on the correlation; cause adjustments to traffic control settings of a traffic light at the intersection based on the rule.

One aspect of the present disclosure includes a method of object-type based traffic control. The method includes receiving video data of traffic flowing through an intersection; based on the video data, determining if a rate of flow of the traffic is greater than a predetermined threshold; determining a correlation between the rate of flow and one of a plurality of object types if the rate of flow is not greater than the predetermined threshold; determining a rule for controlling the traffic flow through the intersection based on the correlation; causing adjustments to traffic control settings of a traffic light at the intersection based on the rule.

BRIEF DESCRIPTION OF THE DRAWINGS

The accompanying drawings illustrate various embodiments of systems, methods, and embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Figure 1:
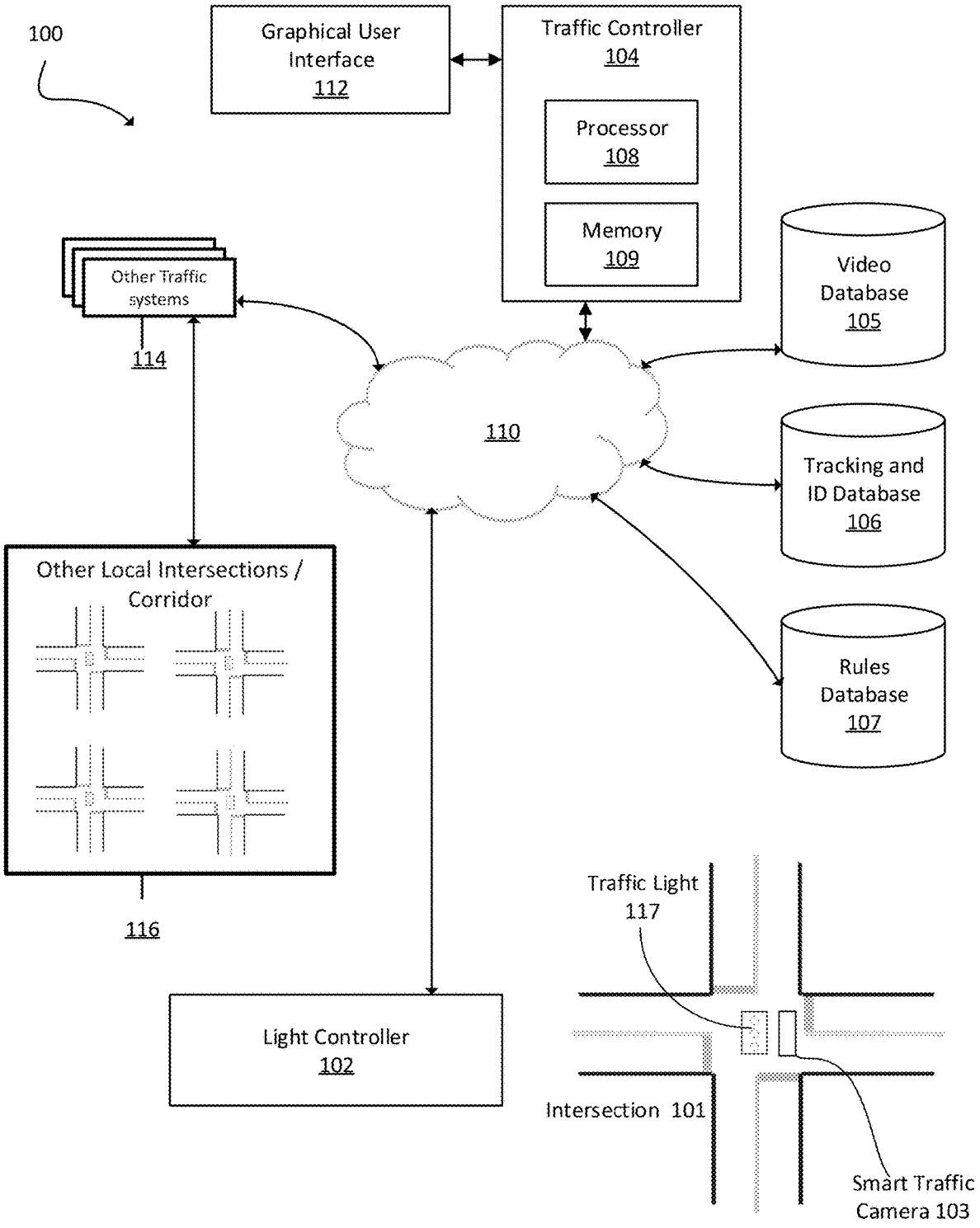
FIG. 1 illustrates a system for controlling traffic, according to an example embodiment.

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context dearly dictates otherwise. Although any systems and methods similar or equivalent to those described herein can be used in the practice or testing of embodiments of the present disclosure, the preferred, systems and methods are now described.

Although the terms first, second, etc. may be used herein to describe various elements, these elements should not be limited by these terms. These terms are only used to distinguish one element from another. For example, a first element could be termed a second element, and similarly, a second element could be termed a first element, without departing from the scope of this disclosure. As used herein, the term "and/or," includes any and all combinations of one or more of the associated listed items.

When an element is referred to as being "connected," or "coupled," to another element, it can be directly connected or coupled to the other element or intervening elements may be present. By contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Specific details are given in the following description to provide a thorough understanding of embodiments. However, it will be understood by one of ordinary skill in the art that embodiments may be practiced without these specific details. For example, systems may be shown in block diagrams so as not to obscure the embodiments in unnecessary detail. In other instances, well-known processes, structures and techniques may be shown without unnecessary detail in order to avoid obscuring embodiments.

Although a flow chart may describe the operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

Example embodiments of the present disclosure will be described more fully hereinafter with reference to the accompanying drawings in which like numerals represent like elements throughout the several figures, and in which example embodiments are shown. Example embodiments of the claims may, however, be embodied in many different forms and should not be construed as limited to the example embodiments set forth herein. The examples set forth herein are non-limiting examples and are merely examples among other possible examples.

FIG. 1 illustrates a system for controlling traffic, according to an example embodiment. The system 100 includes various components including but not limited to, a light controller 102 associated with a smart traffic camera 103 and a traffic light 117 installed at an intersection 101. The traffic controller 102 may or may not be physically located near the smart traffic camera 103 or the traffic light 117. There may be more than one smart traffic camera 103 or one traffic light 117 installed at intersection 101. The smart traffic camera 103 may be one of various types of cameras, including but not limited, to fisheye traffic cameras used to detect and optimize traffic flows at the intersection 101 and/or at other intersections that are part of the same local network or corridor. The smart traffic camera 103 can be any combination of cameras or optical sensors, such as but not limited to fish-eye cameras, directional cameras, infrared cameras, etc. The smart traffic camera 103 can allow for other types of sensors to be connected (e.g., via various known or to be developed wired and/or wireless communication schemes) for additional data collection. The smart traffic camera 103 can collect video and other sensor data at the intersection 101 and convey the same to a traffic controller 104 for further processing, as will be described below.

In one example embodiment, the traffic light 117 can have different traffic signals directed towards all the roads leading to the intersection 101. The different signals may comprise a Red light, Yellow light, and a Green light.

While FIG. 1 illustrates a single smart traffic camera 103 and a single traffic light 117, it should be understood that at the intersection 101 there can be several smart traffic cameras 103 and/or several traffic lights 117 controlled by the light controller 102, where each smart traffic camera 103 and/or traffic light 117 can provide lighting and traffic control signals for one incoming direction of traffic at the intersection 101.

The light controller 102 can include one or more processors and one or more memories. The light controller 102, by implementing computer-readable instructions stored on the one or more memories, can implement traffic control rules and adjust timing and phase of the traffic light 117 according to a give traffic control rule. This will be further described below.

The light controller 102 can be communicatively coupled to the traffic controller 104. The traffic controller 104 can be accessible via a cloud 110 using various known or to be developed wired and/or wireless schemes. The cloud 110 may be a public, private or a hybrid of public and private cloud platforms provided by a cloud service provider. The traffic controller 104 can access one or more databases via the cloud 110 such as video database 105, tracking and ID database 106 and rules database 107, all of which will be further described below. Furthermore, traffic controller 104 can have one or more processors such as processor 108 and one or more memories such as memory 109 having computer-readable instructions stored therein, which when executed by the one or more processors enable the traffic controller 104 to carry out traffic controlling functionalities, as will be further described below.

In one example, the traffic controller 104 can be co-located (physically) with the light controller 102, which together can be co-located in a geographical proximity of smart traffic camera 103. In another example, the light controller 102 and the traffic controller 104 can be the same computing unit implementing functionalities of both, as will be described below. In yet another example embodiment, the traffic controller 104 and the light controller 102 can be part of a centralized traffic control system.

The traffic controller 104 can be accessible by respective/authorized operators. A graphical user interface (GUI) 112 can be associated with the traffic controller 104, which authorized users and operators can log into to gain access to a particular intersection or intersections such as the intersection 101 to provide further input and data, which can be used by the traffic controller 104 to create traffic rules, view various data and information about intersection(s), and designate various zones therein for identifying traffic patterns and applying adaptive traffic control, etc.

In one or more example embodiments, traffic controller 104 can receive traffic patterns, rules, and other information pertaining to nearby intersection(s) such as intersections/corridors 116 from their respective traffic control systems 114. In another example, such additional traffic information pertaining to other intersection(s) need not be limited to nearby intersections but may be of other intersections, in other cities, countries, etc., having similar traffic patterns, which may be used by the traffic controller 104 for adaptive and smart controlling of traffic at the intersection 101 and/or nearby intersections.

While certain components of the system 100 are illustrated in FIG. 1, inventive concepts are not limited thereto and the system 100 may include any number of additional components necessary for operation and functionality thereof.

As mentioned above, the components of the system 100 can communicate with one another using any known or to be developed wired and/or wireless network. For example, for wireless communication, techniques such as Visible Light Communication (VLC), Worldwide Interoperability for Microwave Access (WiMAX), Long Term Evolution (LTE), Fifth Generation (5G) cellular, Wireless Local Area Network (WLAN), Infrared (IR) communication, Public Switched Telephone Network (PSTN), Radio waves, and other communication techniques known in the art may be utilized.

Figure 2:
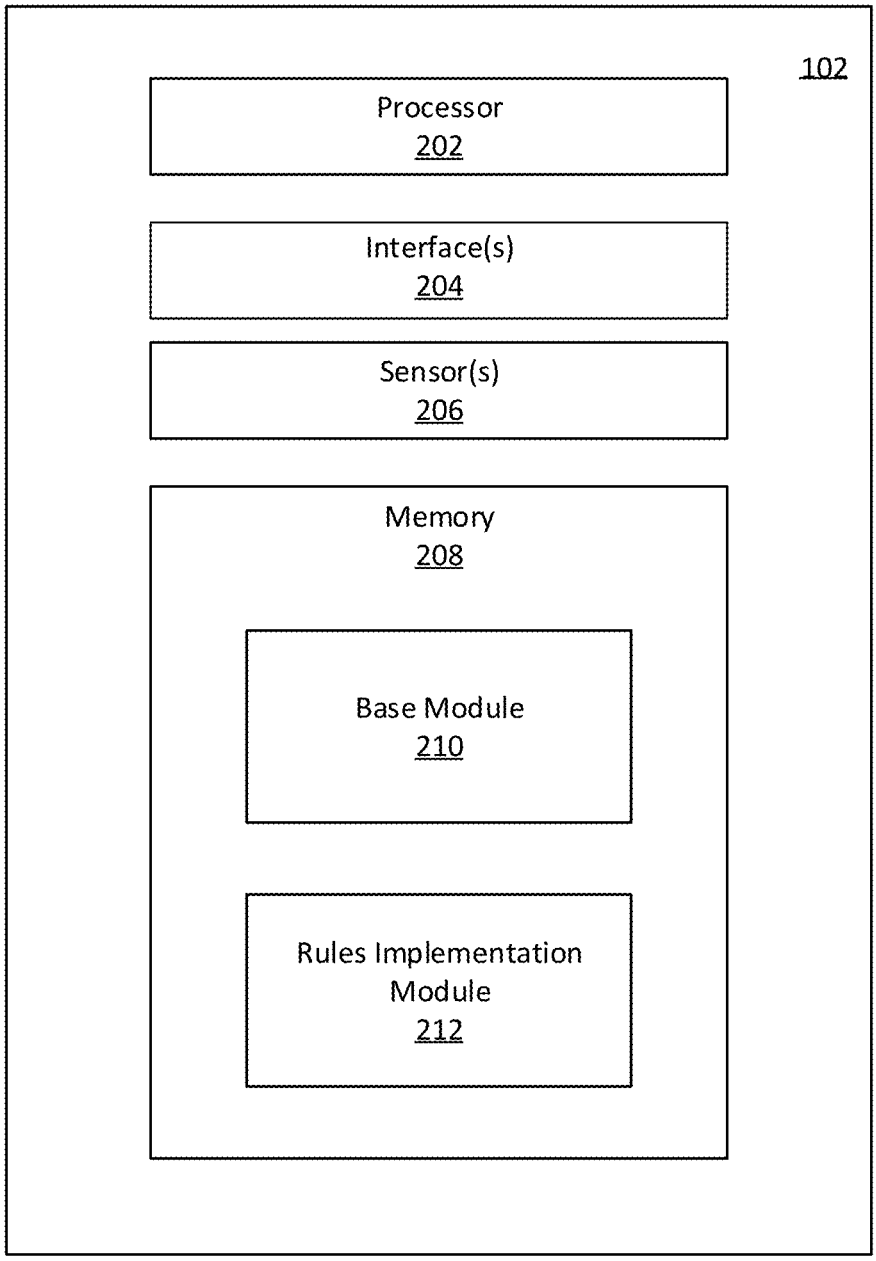
FIG. 2 illustrates a block diagram showing different components of a light controller of the system of FIG. 1, according to an example embodiment.

FIG. 2 illustrates a block diagram showing different components of a light controller of the system of FIG. 1, according to an example embodiment. As mentioned above, the light controller 102 can be physically located near the smart traffic camera 103 and/or the traffic light 117 (e.g., at a corner of the intersection 101) or alternatively can communicate with the smart traffic camera 103 and/or the traffic light 117 wirelessly or via a wired communication scheme (be communicatively coupled thereto).

The light controller 102 can comprise a processor 202, interface(s) 204, sensor(s) 206, and memory 208. The processor 202 may execute an algorithm stored in the memory 208 for maintaining control of traffic. The processor 202 may also be configured to decode and execute any instructions received from one or more other electronic devices or server(s). The processor 202 may include one or more general purpose processors (e.g., INTEL® or Advanced Micro Devices® (AMD) microprocessors, ARM) and/or one or more special purpose processors (e.g., digital signal processors or Xilinx® System On Chip (SOC) Field Programmable Gate Array (FPGA) processor). The processor 202 may be configured to execute one or more computer-readable program instructions, such as program instructions to carry out any of the functions described in this description.

The interface(s) 204 may assist an operator in interacting with the light controller 102. The interface(s) 204 of the light controller 102 may be used instead of or in addition to the graphical user interface 112 that is centrally accessible by operators or may be the same as the graphical user interface 112. The interface(s) 204 either accept an input from the operator or provide an output to the operator, or may perform both the actions. The interface(s) 204 may either be a Command Line Interface (CLI), Graphical User Interface (GUI), voice interface, and/or any other user interface known in the art or to be developed.

The sensor(s) 206 can be one or more smart cameras such as fish-eye cameras mentioned above or any other type of sensor/capturing device that can capture various types of data regarding activities at the intersection 101. Any one such sensor 206 can be located at/attached to the light controller 102, located at/attached to the smart traffic camera 103, or remotely installed from the light controller 102 and the smart traffic camera 103 and communicatively coupled to one or both.

As mentioned, the sensor(s) 206 may be installed to capture objects moving across the roads. The sensor(s) 206 used may include, but are not limited to, optical sensors such as fish-eye cameras mentioned above, Closed Circuit Television (CCTV) cameras, and Infrared cameras. Further, sensor(s) 206 can include, but not limited to induction loops, Light Detection and Ranging (LIDAR), weather sensors, motion sensors, audio sensors, pneumatic road tubes, magnetic sensors, piezoelectric cable, and weigh-in motion sensor, which may also be used alone or in combination with the optical sensor(s).

The memory 208 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 208 may comprise modules implemented as a program and executed by the processor 202. In one case, the memory 208 may comprise a base module (service) 210 and a rules implementation module 212. These modules (services) are computer-readable instructions stored on the memory 208 for execution by the processor 202. Functionalities implemented by executing based module 210 and/or the rules implementation module 212 will be further described below with reference to FIG. 7.

Figure 3:
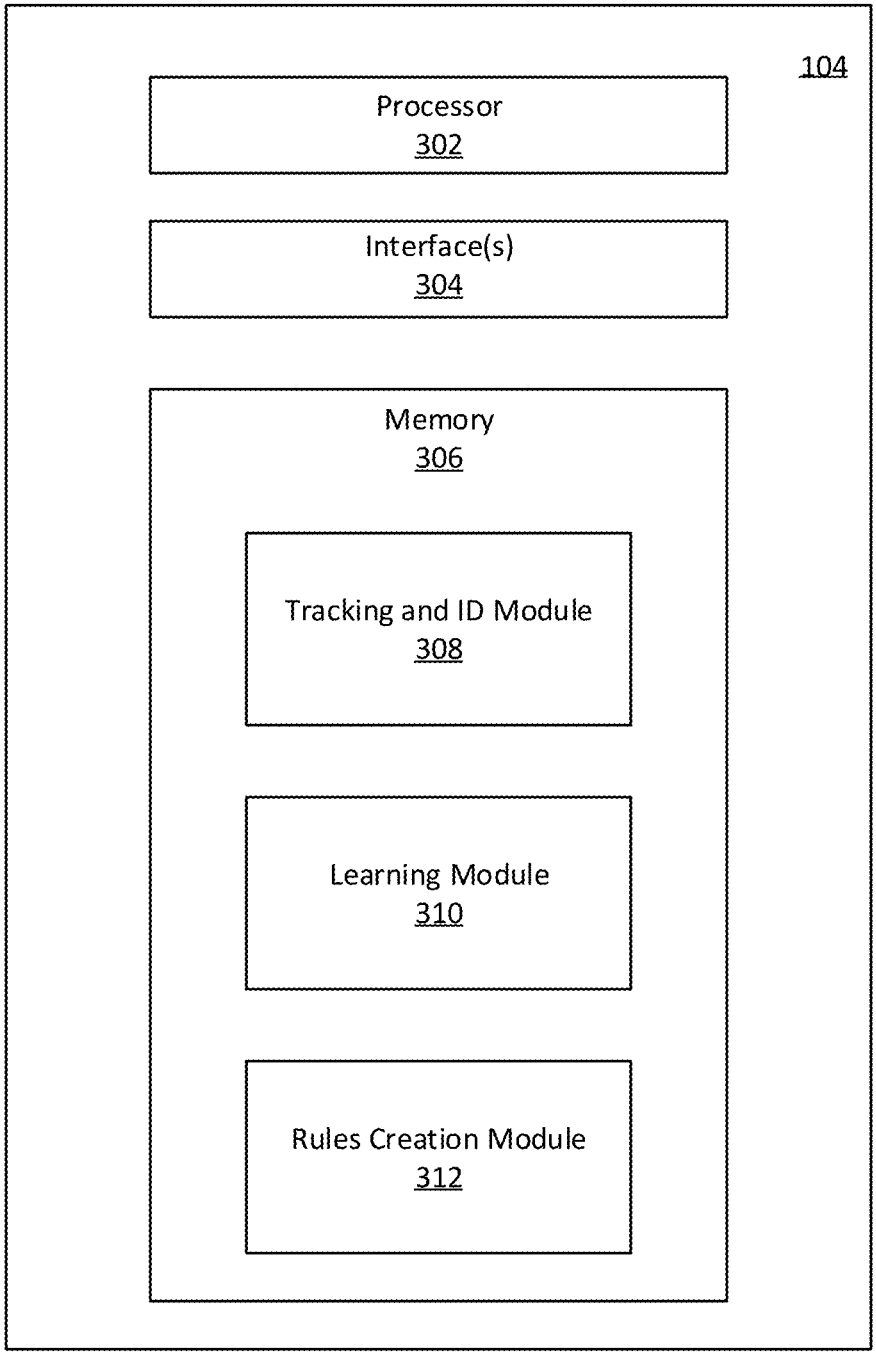
FIG. 3 illustrates a block diagram showing different components of a traffic controller of the system of FIG. 1, according to an example embodiment.

FIG. 3 illustrates a block diagram showing different components of a traffic controller of the system of FIG. 1, according to an example embodiment. As mentioned above, the traffic controller 104 can be accessed via the cloud 110 or can be physically located near the light controller 102, the smart traffic camera 103 and/or the traffic light 117 (e.g., at a corner of the intersection 101).

The traffic controller 104 can comprise a processor 302 (which may be the same as the processor 108 described with reference to FIG. 1), interface(s) 304 and one or more memories such as a memory 306 (which may be the same as memory 109 described with reference to FIG. 1). The processor 302 may execute an algorithm stored in the memory 306 for maintaining control of traffic. The processor 302 may also be configured to decode and execute any instructions received from one or more other electronic devices or server(s). The processor 302 may include one or more general purpose processors (e.g., INTEL® or Advanced Micro Devices® (AMD) microprocessors, ARM) and/or one or more special purpose processors (e.g., digital signal processors or Xilinx® System On Chip (SOC) Field Programmable Gate Array (FPGA) processor). The processor 302 may be configured to execute one or more computer-readable program instructions, such as program instructions to carry out any of the functions described in this description.

The interface(s) 304 may assist an operator in interacting with the traffic controller 104. The interface(s) 304 of the traffic controller 104 may be used instead of or in addition to the graphical user interface 112 that is centrally accessible by operators or may be the same as the graphical user interface 112. The interface(s) 304 either accept an input from the operator or provide an output to the operator, or may perform both the actions. The interface(s) 304 may either be a Command Line Interface (CLI), Graphical User Interface (GUI), voice interface, and/or any other user interface known in the art or to be developed.

The memory 306 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 306 may comprise modules implemented as a program and executed by the processor 302. In one case, the memory 306 may comprise a tracking and ID module 308, a learning module 310, and/or a rules creation module 312. These modules (services) are computer-readable instructions stored on the memory 306 for execution by the processor 302. Functionalities implemented by executing the tracking and ID module 308, the learning module 310 and/or the rules creation module 312 will be further described below with reference to FIGS. 4-6.

As mentioned above, light controller 102 and traffic controller 104 may form a single physical unit, in which case system components of each, as described with reference to FIG. 1 and FIG. 2 may be combined into one.

Having described examples of system components, the disclosure now turns to example embodiments that enable generation and application of traffic rules (traffic control rules) based on the type of objects (e.g., vehicles) detected at an intersection at any given point in time.

Figure 4:
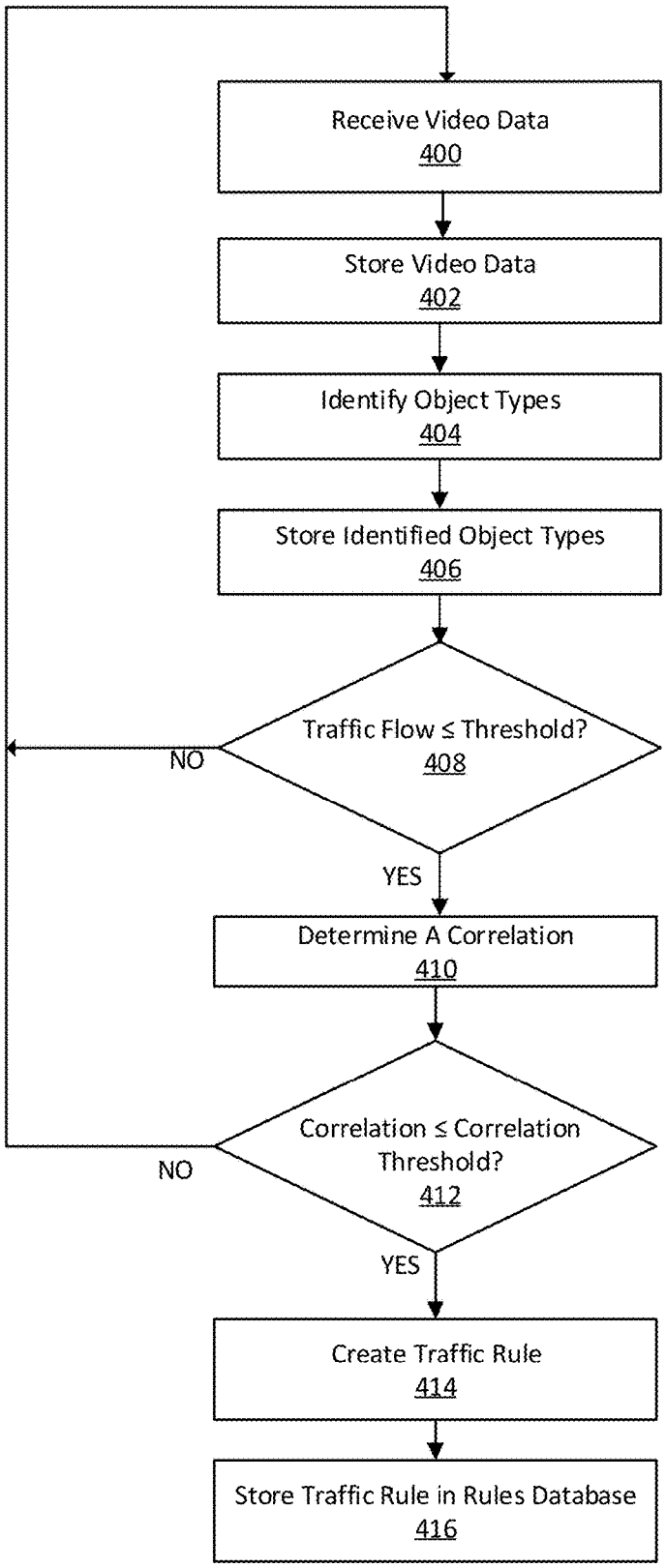
FIG. 4 illustrates a flowchart showing a method executed by the traffic controller of FIG. 1, according to an example embodiment.

FIG. 4 illustrates a flowchart showing a method executed by the traffic controller of FIG. 1, according to an example embodiment. FIG. 4 will be described with reference to FIGS. 1-3 and from the perspective of traffic controller 104. However, it will be apparent to those having ordinary skill in the art that functionalities of the traffic controller 104 will be implemented by the processor 302 executing one or more computer-readable instructions (modules 308, 310 and/312) stored on the memory 306 of traffic controller 104.

At step 400, the traffic controller 104 may receive video data from the smart traffic camera 103 and/or sensors 206 (directly) or alternatively receive the video data of traffic captured by the smart traffic camera 103 via the light controller 102.

At step 402, the traffic controller 104 may store the received video data in the video database 105.

The video data may also be referred to as sensor data captured by the sensors 206 of light controller 102 and may be received and stored in real-time. The sensor data may include sensor data of the objects moving across the intersection 101.

At step 404, the traffic controller 104 may implement computer-readable instructions corresponding to the tracking and ID module 308, to analyze the stored video data in order to identify and track the types of objects (e.g., type of vehicles) detected in the video data at the intersection 101. The detection of the types of vehicles can be based on template matching or any other known or to be developed method of image/video processing for detecting object types in captured video/image data. As mentioned above, the types of vehicles may include, but are not limited to, cars, trucks, buses, bikes, etc. Furthermore, cars, trucks, buses and bikes can further be broken down into sub-categories. For example, cars can be categorized into sedans, vans, SUVs, etc. Trucks can be categorized into light trucks such as pickup trucks, medium trucks such as box trucks or fire trucks, heavy duty trucks such as garbage trucks, crane movers, 18-wheelers, etc.

In one example, the traffic controller assigns a type to each identified object (car) (associates each identified object with one of a plurality of object types) and may then determine a number of the detected objects having the same object type (e.g., the number of cars, the number of trucks, etc.).

At step 406, the traffic controller 104 stores the results of the analysis and identification of object types in the tracking and ID database 106.

In one example embodiment, the steps 400-406 may be continuously performed by the traffic controller 104 as traffic flows through the intersection 101 continuously.

At step 408, the traffic controller 104 determines a rate of traffic flow at the intersection 101 and whether the determined rate is less than or equal to some predetermined threshold. The threshold can be a configurable parameter set by an operator of traffic controller 104 (e.g., through the interface 304 or the graphical user interface 112) and may be determined based on experiments and/or empirical studies. For example, the threshold may be set to 10 vehicles per minute.

In one example, the traffic controller 104 can receive instructions via the graphical user interface 112 to designate entrance, monitoring and exit zones at the intersection 101 and then apply analytics to the video of vehicles moving through the intersection 101 to determine the number of vehicles entering and exiting the intersection 101 at any given point in time. Based on this determination, the traffic controller 104 can determine the rate of traffic flow at the intersection 101. The traffic flow rate may be directional specific, meaning that it may be specified for traffic associated with any one or more of north-south, north-east, north-west, east-north, east-south, east-west, west-east, west-north, west-south, south-north, south-east and south-west bound directions at the intersection 101.

In another example, the traffic controller 104 may determine traffic flow rates using various techniques which are well known in the art. In one example, a traffic flow rate may be determined by multiplying a predicted space mean speed (Vse) with a traffic density (k). For example, Vse of 60 miles/hour with k=20 vehicles/mile yields a traffic flow rate of 1200 vehicles/hour.

In one example, the tracking and ID database 106 may have stored therein, the rates of traffic flows in addition to identified object (number of objects) associated with each type of object, as reflected in Table 1 below.

TABLE 1

Tracking and ID database 106 comprising traffic flow rates, type of objects, and count of objects

| Traffic Flow Rate (object/min) | Number of object ID's - Car | Number of object ID's - Trucks | Number of object ID's - Motorcycles |
|---|---|---|---|
| 15 | 12 | 2 | 1 |
| 10 | 7 | 3 | 0 |
| 15 | 12 | 1 | 2 |
| 20 | 17 | 0 | 3 |
| 4 | 1 | 4 | 0 |
| 4 | 0 | 5 | 0 |
| 11 | 8 | 2 | 1 |
| 20 | 25 | 0 | 0 |

If at step 408, the traffic controller 104 determines that the traffic flow rate is not less than or equal to the threshold (is greater than the threshold), the process reverts back to step 400 and the traffic controller 104 may repeat steps 400-408.

However, if at step 408, the traffic controller 104 determines that the traffic flow rate is less than or equal to the threshold, then at step 410, the traffic controller 104 determines a correlation between each of the identified object types (a plurality of object types) stored in the tracking and ID database 106 and the traffic flow rate determined at step 408. More specifically, at step 408, the traffic controller 104 determines a correlation between the number of objects (cars) associated with each object type (as determined per step 404) and the rate of traffic flow. This may be referred to as an object type-traffic flow rate correlation. This step can be implemented when the processor 302 implements the computer-readable instructions corresponding to the learning module 310. This step will be further described with reference to FIG. 5.

Figure 5:
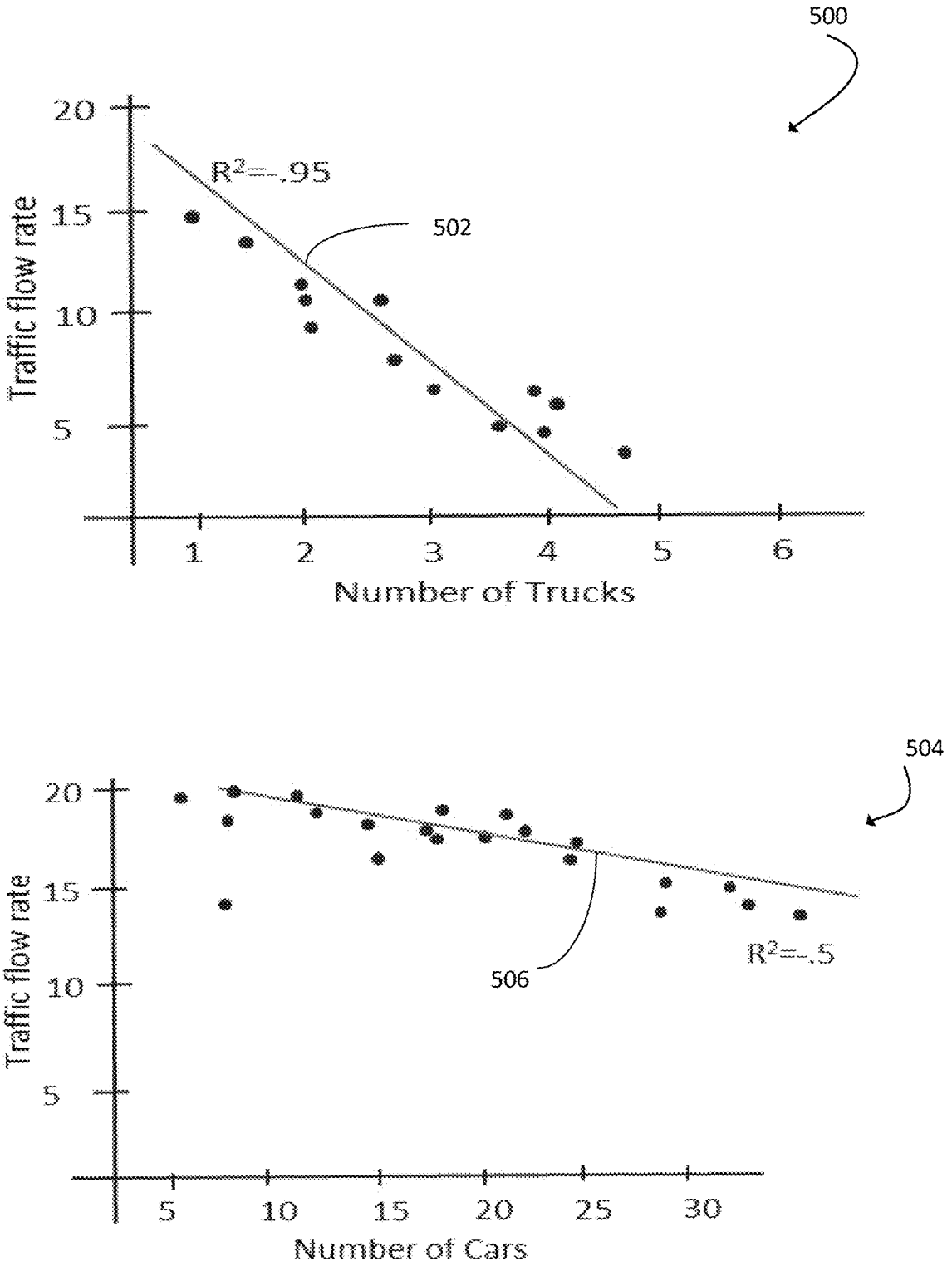
FIG. 5 illustrates a determination of an object type-traffic flow correlation, according to an example embodiment.

FIG. 5 illustrates a determination of an object type-traffic flow rate correlation, according to an example embodiment. As shown in FIG. 5 and according to one example, the traffic controller establishes a correlation between the number of vehicles associated with each identified object type (e.g., each type of vehicle identified at the intersection 101) and the traffic flow rate. This correlation may be established over a period of time (e.g., 1 minute, 5 minutes, 1 hour, 24 hours, a week, a month, etc.).

For example, graph 500 of FIG. 5 shows, a correlation between the number of trucks at the intersection 101 and a traffic flow rate over a given period of time. Line 502 on graph 500 shows a coefficient of determination (e.g., $R^2$=−0.9), which signifies the level of correlation between the number of trucks and the traffic flow rate. This coefficient of determination can be referred to as a correlation coefficient. This coefficient can vary between −1 and 1. The closer the coefficient is to −1, the higher the inverse correlation between the underlying factors (e.g., traffic flow rate decreases as the number of trucks increases). Similarly, the closer the coefficient is to 1, the higher the direct correlation between the underlying factors.

Similarly, graph 504 shows a correlation between the number of cars at the intersection 101 and the traffic flow rate over the given period of time, with a corresponding coefficient of determination (correlation coefficient) shown by line 506 (e.g., $R^2$=−0.5).

While FIG. 5 illustrates only two example correlations between number of trucks and the traffic flow rate and the number of cars and the traffic flow rate, inventive concepts are not limited thereto and traffic controller 104 can determine such correlation between the traffic flow rate and any number of objects associated with any identified object type at the intersection 101.

Returning back to FIG. 4, after determining a corresponding correlation (and a corresponding coefficient of determination) at step 410, at step 412, traffic controller 104 determines if any of the determined correlations (or the corresponding coefficient of determination) is less than or equal to a correlation threshold, which can be a configurable parameter determined and programmed into the traffic controller 104 based on experiments and/or empirical studies). For example, the threshold can be set to "−0.9", which can be indicative of a highly inverse correlation. For example, a correlation of −0.95 as shown in FIG. 5 can indicate that there is a high correlation between the number of trucks detected at the intersection 101 and the decrease in traffic rate detected by the traffic controller 104.

If at Step 412, the correlation is determined not be less than or greater than the correlation threshold (is greater than the correlation threshold), then the process reverts back to step 400 and the controller 104 repeats steps 400-412.

However, if at step 412, the traffic controller 104 determines that then correlation is less than or equal to the correlation threshold, then at step 414, the traffic controller 104 creates a traffic rule. The term traffic rule(s) can be used interchangeably with the term traffic control rule(s).

In one example, such traffic rule(s) are created based on known or to be developed optimization rules, or various input criteria such as normal traffic flow rate (received from external sources). This can be, for example, based on data received from other traffic systems (e.g., traffic systems 114) having similar rules established for similar correlations. In another example, the traffic controller 104 can determine a proportion between a normal (average) traffic rate and the current identified traffic flow rate and based on such proportion adjust current or average traffic control signals and durations thereof. For example, if the traffic flow rate has decreased by 50% due to presence of 5 trucks at the intersection 101 and assuming that the average duration of a green light is set to 30 seconds, the traffic controller 104 can create a rule, whereby, upon detection of 4-6 trucks (or exactly 5 trucks), the duration of green light is increased by 50% (e.g., to 45 seconds instead of 30 seconds).

Thereafter, at step 416, the traffic controller 104 stores the created traffic rule in the rules database 107. In one example, the traffic controller 104 stores the created traffic rule in association with the correlation determined at step 410, for future reference as will be described below.

For example, the rules database 107 can have stored therein the created rules per Table 2 shown below.

TABLE 2

Traffic rules stored in rules creation database 107

| Number of objects | Type of object (i.e., object ID) | Traffic flow rate (objects/min.) | Green Light settings (traffic optimization calculation) |
|---|---|---|---|
| 4 | Truck | 4 | +10 secs |
| 5 | Truck | 4 | +12.5 secs |

Figure 6:
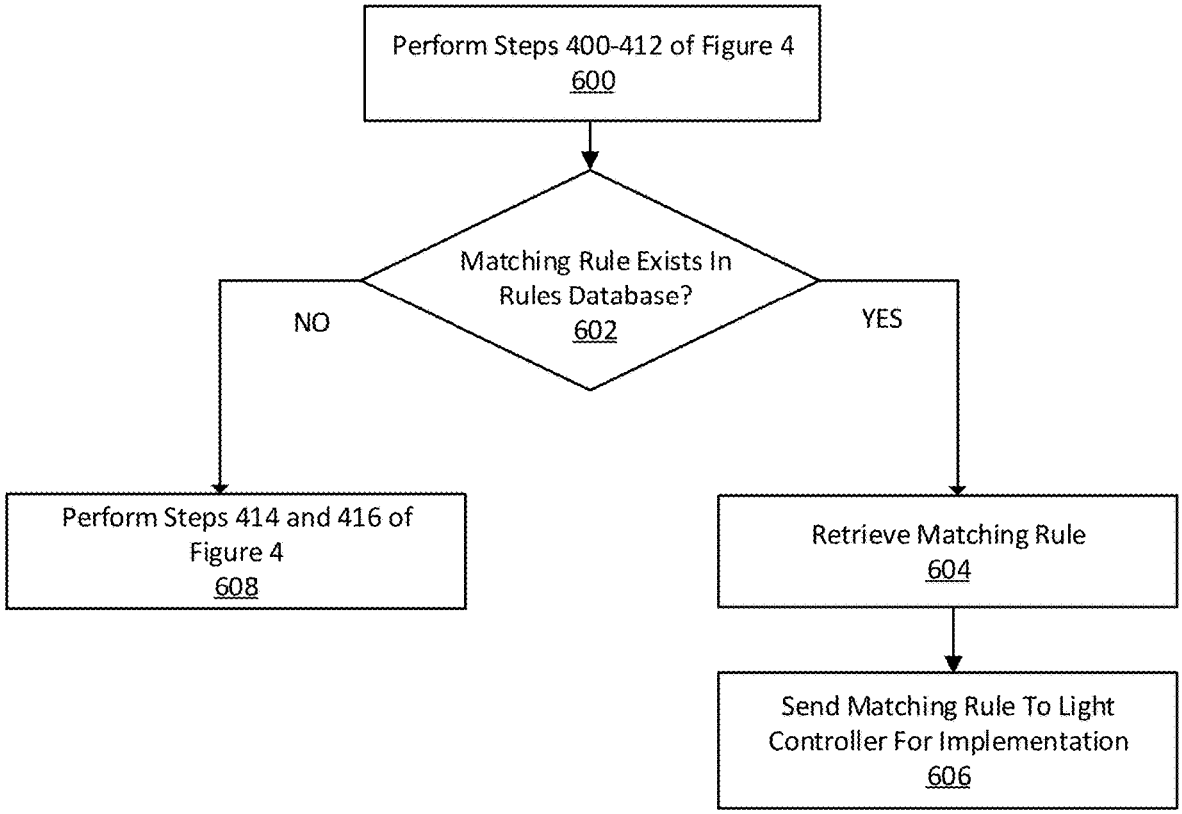
FIG. 6 illustrates a flowchart showing a method executed by the traffic controller of FIG. 1, according to an example embodiment.

FIG. 6 illustrates a flowchart showing a method executed by the traffic controller of FIG. 1, according to an example embodiment. FIG. 6 will be described with reference to FIGS. 1-5 and from the perspective of traffic controller 104. However, it will be apparent to those having ordinary skill in the art that functionalities of the traffic controller 104 will be implemented by the processor 302 executing one or more computer-readable instructions (modules 308, 310 and/312) stored on the memory 306 of traffic controller 104.

Several steps of FIG. 6 will be implemented in the same manner as discussed above with reference to FIG. 5. Therefore, these steps will not be described in detail for sake of brevity.

At step 600, the traffic controller 104 performs steps 400-412 of FIG. 4 in the same manner as described above with reference to FIG. 4. Therefore, these steps will not be described further.

At step 602 and after determining that the correlation is less than or equal to the correlation threshold as per step 412, the traffic controller 104 may determine if a matching rule exists in the rules database 107 for the correlation identified per step 410. For example, assume that currently, the traffic controller 104 has detected 5 trucks at the intersection 101. Furthermore, assume that the traffic controller 104 has previously performed the process of FIG. 4 and established that there is a correlation between a 50% reduction in traffic flow rate and the presence of 5 trucks at the intersection 101. Thus the traffic controller 104 may have established a traffic rule to increase the green light by 50% (per the example described above) when 5 trucks are detected at the intersection 101.

Therefore, at step 602, the traffic controller 104 may search the rules database 107 to see if a matching rule exists for when 5 trucks are detected at the intersection 101. If the matching rule exists, which in this example it does, then at step 604, the traffic controller 104 retrieves the rule from the rules database 107 and then at step 606 transmits the rule to the light controller 102 for implementation at the traffic light 117.

However, if at step 602, the traffic controller 104 determines that no match for the identified correlation exists in the rules database 107, then at step 608, the traffic controller 104 performs steps 414 and 416 of FIG. 4 to create a rule and store the same in the rules database 107 for future use. Thereafter, the process proceeds to step 606, as described above.

Having describes the rules creation and providing of the same by the traffic controller 104 to light controller 102, the disclosure now turns to describing functionalities of the light controller 102 for retrieving and implementing traffic rules created by traffic controller 104.

Figure 7:
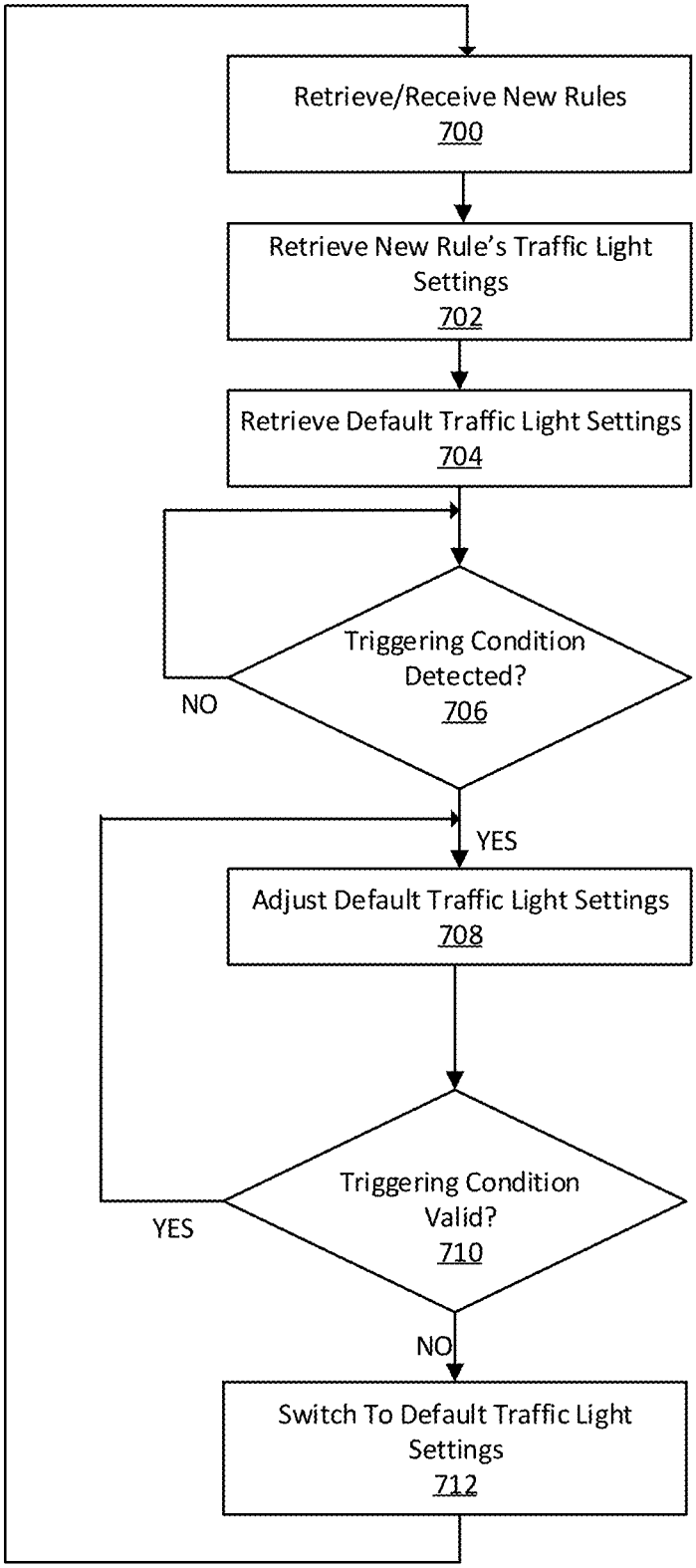
FIG. 7 illustrates a flowchart showing a method executed by the light controller of FIG. 1, according to an example embodiment.

FIG. 7 illustrates a flowchart showing a method executed by the light controller of FIG. 1, according to an example embodiment. FIG. 7 will be described with reference to FIGS. 1-6 and from the perspective of the light controller 102. However, it will be apparent to those having ordinary skill in the art that functionalities of the light controller 102 will be implemented by the processor 202 executing one or more computer-readable instructions (modules 210 and/or 212) stored on the memory 208 of the light controller 102.

At step 700, the light controller 102 monitors the rules database 107 for new rules created and stored thereon by the traffic controller 104. Alternatively, and as described above, the light controller 102 may receive the new rules upon creation thereof, from the traffic controller 104. These new traffic rules may be referred to as a newly discovered traffic rules by the light controller 102. Step 700 may be performed by the processor 202 implementing computer-readable instructions corresponding to the rules implementation module 212.

At step 702, the light controller 102 retrieves, from the rules database 107, the traffic light settings for one or more of the newly discovered traffic rules and can optionally store them on the memory 206.

Figure 8:
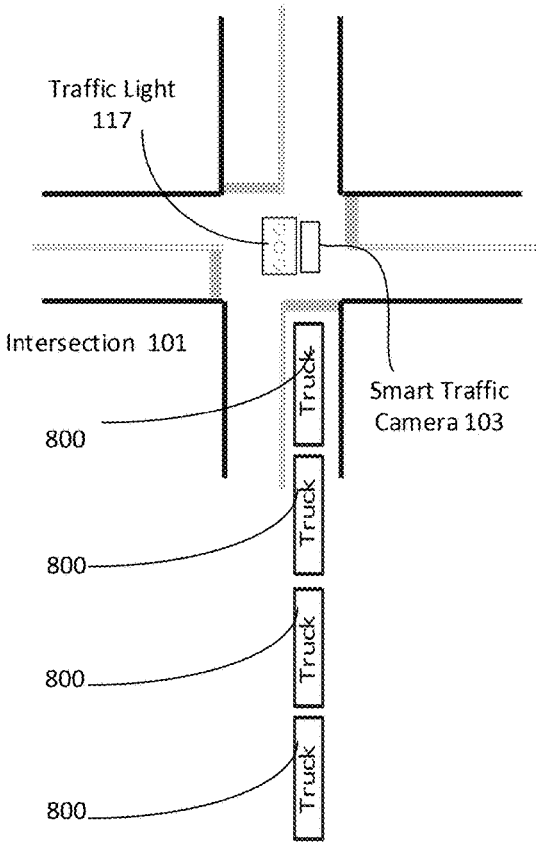
FIG. 8 illustrates an example of a default traffic light setting for an intersection, according to one example embodiment.

At step 704, the light controller 102 may retrieve a default traffic light setting. An example default traffic light setting for the intersection 101 is shown in FIG. 8. FIG. 8 illustrates an example of a default traffic light setting for an intersection, according to one example embodiment.

As shown in FIG. 8, the intersection 101 can be divided into phases A-D, where each phase indicates an incoming traffic facing a traffic light 117 at the intersection 101. Furthermore, in FIG. 8 as assumption is made that at phase C of the intersection 101, 5 trucks 800 are detected.

Furthermore, FIG. 8 shows an example table of default light setting 802 for the intersection 101 and each phase thereof. In the example of FIG. 8, the default setting for phases A and C of the intersection 101 are the same and includes 10 seconds of green light, 5 seconds of yellow light and 10 seconds of red light. Given that in the example of FIG. 8 phases A and C face each other their light durations are the same. The same is shown to be the case in setting 802 for phases B and D. However, depending on the particulars of the intersection 101, the timings of phases A-C can be different from phases B-D.

Referring back to FIG. 7, at step 706, the light controller 102 determines if a triggering condition is detected. A triggering condition can be a detection of a number of specific types of objects/vehicles, to which one or more of the retrieved traffic rules apply. For example, the triggering condition can be the detection of 5 trucks at the intersection 101. Furthermore, the triggering condition can be a detection of a rate of traffic flow that is equal to or less than a threshold (e.g., equal to or less than 10 vehicles per minute).

Upon detecting the triggering condition at step 706, then at step 708, the light controller applies the light settings of a corresponding one of newly discovered rules to the default traffic light settings at the traffic light 117 (adjust the default traffic light settings). The step 708 may be implemented by the processor 202 implementing computer-readable instructions corresponding to the base module 310. In this example, given that the 5 trucks are detected at the phase C and that the newly discovered rule is that the green light is to be increased by 50% when 5 trucks are detected (per the example described above with reference to FIGS. 4 and 6), then light controller 102 increases the green light duration of setting 802 for A-C phases by 50% to 15 seconds.

At step 710, the light controller 102 determines if the triggering condition is still valid. If it is, the light controller 102 continues to perform step 708. Once the triggering condition is no longer valid, then at step 712, the light controller 102 changes the traffic light setting on the traffic light 117 to the default traffic light settings of step 704. Thereafter, the process reverts back to step 700.

In one example and regardless of whether the light controller 102 is implementing the default traffic light setting or an adjusted version thereof based on the newly discovered rule(s), the light controller 102 can be configured to receive an emergency situation indication. This may be made possible for example, receiving audio signals via an audio sensor at the smart traffic camera 103 indicating the audio sounds emitted by a siren of an approaching fire truck or ambulance. Accordingly, the light controller 102 can override the currently implemented traffic light setting by applying an emergency traffic light setting according to which, for example, the light corresponding to the direction from which the ambulance or the fire truck is approaching the intersection 101, is immediately switch to green and remains green for a period of 30 seconds.

Another example of an emergency situation is one provided by a traffic control operator (e.g., via the graphical user interface 112) indicating a security situation or a police pursuit situation, which results in an immediate override of currently implemented traffic light settings at one or more intersections on the corresponding route so that emergency vehicles or law enforcement vehicles can pass through.

In another example, the light controller 102 may detect an abnormality in the traffic pattern or the rate of traffic flow for which no rule exists. For example, there may be a situation in which the rate of traffic flow falls below the threshold (e.g., below 10 vehicles per minute in phase C). However, the light controller 102 is unable to identify 5 trucks at phase C of the intersection 101. Therefore, the light controller 102 is unable to find a matching newly discovered traffic rule, in order to use the traffic light settings thereof to adjust the timing of lights at the traffic light 117. In such case, the light controller 102 may send a signal to the traffic controller 104 requesting an operator's feedback or instructions on changes to be made to the traffic light settings at the intersection 101 in order to alleviate the abnormally low rate of traffic flow.

Example embodiments of the present disclosure may be provided as a computer program product, which may include a computer-readable medium tangibly embodying thereon instructions, which may be used to program a computer (or other electronic devices) to perform a process. The computer-readable medium may include, but is not limited to, fixed (hard) drives, optical disks, compact disc read-only memories (CD-ROMs), and magneto-optical disks, semiconductor memories, such as ROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware).

Moreover, example embodiments of the present disclosure may also be downloaded as one or more computer program products, wherein the program may be transferred from a remote computer to a requesting computer by way of data signals embodied in a carrier wave or other propagation medium via a communication link (e.g., a modem or network connection).

What is claimed is:

1. A device comprising:

memory having computer-readable instructions stored therein; and one or more processors configured to execute the computer-readable instructions to:

receive video data of traffic flowing through an intersection;

based on the video data, determine if a rate of flow of the traffic is greater than a predetermined threshold;

determine a correlation coefficient for one object type of a plurality of object types if the rate of flow is not greater than the predetermined threshold, wherein the correlation coefficient for the one object type is indicative of a direct or inverse correlation between the rate of flow and a number of objects associated with the one object type;

determine a rule for controlling the traffic flow through the intersection based on the correlation coefficient; and cause adjustments to traffic control settings of a traffic light at the intersection based on the rule.

2. The device of claim 1, wherein the one or more processors are configured to execute the computer-readable instructions to:

identify objects in the video data;

associate each identified object with an object type from the plurality of object types, the plurality of object types being one or more of cars, trucks, bicycles and motor cycles; and determine a number of objects associated with each object type of the plurality of object types.

3. The device of claim 2, wherein the one or more processors are configured to execute the computer-readable instructions to determine the rule if the correlation coefficient between the number of objects associated with the one object type of the plurality of object types and the rate of flow of the traffic is equal to or less than a second predetermined threshold.

4. The device of claim 3, wherein the one or more processors are configured to execute the computer-readable instructions to determine the rule based on rules implemented for the same correlation at one or more additional intersections.

5. The device of claim 3, wherein the one or more processors are configured to execute the computer-readable instructions to determine the rule by:

determining if a matching rule for the correlation was previously created; and selecting the matching rule as the rule for controlling the traffic flow.

6. The device of claim 2, wherein the objects are vehicles forming the traffic at the intersection.

7. The device of claim 1, wherein the one or more processors are configured to execute the computer-readable instructions to cause the adjustments by sending the traffic control settings to a light controller associated with the traffic light, wherein the light controller is configured to apply the adjustments upon detecting a triggering condition, the triggering condition being a current number of objects at the intersection that are associated with the one object type of the plurality of object types corresponding to a number of the objects associated with the one object type of the plurality of object types based on which the rule is created.

8. The device of claim 1, wherein the correlation coefficient ranges between −1 and 1.

9. The device of claim 1, wherein the one object type is a first object type, the plurality of object types further comprises a second object type different from the first object type, wherein the one or more processors are further configured to execute the computer-readable instructions to:

determine the lesser of the correlation coefficient for the first object type and the correlation coefficient for the second object type; and determine the rule by determining a rule to increase the flow of the objects associated with the object type of the first object type or the second object type that has the lesser of the correlation coefficients.

10. The device of claim 1, wherein the one or more processors are configured to execute the computer-readable instructions to:

receive video data of traffic flowing through designated zones associated with the intersection, and wherein the correlation coefficient for the one object type is determined based on the number of objects associated with the one object type in the designated zones.

11. One or more non-transitory computer-readable medium having computer-readable instructions stored therein, which when executed by one or more processors, cause the one or more processors to:

receive video data of traffic flowing through an intersection;

based on the video data, determine if a rate of flow of the traffic is greater than a predetermined threshold;

determine a correlation coefficient for at least one object type of a plurality of object types if the rate of flow is not greater than the predetermined threshold, wherein the correlation coefficient for the at least one object type is indicative of a direct or inverse correlation between the rate of flow and a number of objects associated with the at least one object type;

determine a rule for controlling the traffic flow through the intersection based on the correlation coefficient; and cause adjustments to traffic control settings of a traffic light at the intersection based on the rule.

12. The one or more non-transitory computer-readable medium of claim 11, wherein the execution of the computer-readable instructions by the one or more processors cause the one or more processors to:

identify objects in the video data;

associate each identified object with an object type from the plurality of object types, the plurality of object types being one or more of cars, trucks, bicycles and motor cycles; and determine a number of objects associated with each object type of the plurality of object.

13. The one or more non-transitory computer-readable medium of claim 12, wherein the execution of the computer-readable instructions by the one or more processors cause the one or more processors to determine the rule if the correlation coefficient between the number of objects associated with the at least one object type of the plurality of object types and the rate of flow of the traffic is equal to or less than a second predetermined threshold.

14. The one or more non-transitory computer-readable medium of claim 13, wherein the execution of the computer-readable instructions by the one or more processors cause the one or more processors to determine the rule based on rules implemented for the same correlation at one or more additional intersections.

15. The one or more non-transitory computer-readable medium of claim 13, wherein the execution of the computer-readable instructions by the one or more processors cause the one or more processors to determine the rule by:

determining if a matching rule for the correlation was previously created; and selecting the matching rule as the rule for controlling the traffic flow.

16. The one or more non-transitory computer-readable medium of claim 12, wherein the one or more non-transitory computer-readable medium is implemented on a cloud network that is communicatively coupled to the traffic light via a light controller.

17. The one or more non-transitory computer-readable medium of claim 11, wherein the execution of the computer-readable instructions by the one or more processors cause the one or more processors to cause the adjustments by sending the traffic control settings to a light controller associated with the traffic light, wherein the light controller is configured to apply the adjustments upon detecting a triggering condition, the triggering condition being a current number of objects at the intersection that are associated with the at least one object type of the plurality of object types corresponding to a number of the objects associated with the at least one object type of the plurality of object types based on which the rule is created.

18. A method of object-type based traffic control, comprising:

receiving video data of traffic flowing through an intersection;

based on the video data, determining if a rate of flow of the traffic is greater than a predetermined threshold;

determining a correlation coefficient for one object type of a plurality of object types if the rate of flow is not greater than the predetermined threshold, wherein the correlation coefficient for the one object type is indicative of a direct or inverse correlation between the rate of flow and a number of objects associated with the one object type;

determining a rule for controlling the traffic flow through the intersection based on the correlation coefficient; and causing adjustments to traffic control settings of a traffic light at the intersection based on the rule.

19. The method of claim 18, further comprising:

identifying objects in the video data;

associating each identified object with an object type from the plurality of object types, the plurality of object types being one or more of cars, trucks, bicycles and motor cycles; and determining a number of objects associated each object type of the plurality of object types.

20. The method of claim 19, wherein the determining of the rule is executed if the correlation coefficient between the number of objects associated with the one object type of the plurality of object types and the rate of flow of the traffic is equal to or less than a second predetermined threshold.

* * * * *